US008452213B2

(12) United States Patent
Okabe

(10) Patent No.: US 8,452,213 B2
(45) **Date of Patent: *May 28, 2013**

(54) IMAGE FORMING APPARATUS

(75) Inventor: Yasushi Okabe, Aichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 46 days.

This patent is subject to a terminal disclaimer.

(21) Appl. No.: 13/306,576

(22) Filed: Nov. 29, 2011

(65) Prior Publication Data

US 2012/0070189 A1 Mar. 22, 2012

Related U.S. Application Data

(63) Continuation of application No. 12/358,483, filed on Jan. 23, 2009, now Pat. No. 8,078,085.

(30) Foreign Application Priority Data

Jan. 24, 2008 (JP) ..... 2008-013715

(51) Int. Cl.
*G03G 15/00* (2006.01)

(52) U.S. Cl.
USPC ..... 399/205; 399/118

(58) Field of Classification Search
USPC ..... 399/118, 205
See application file for complete search history.

(56) References Cited

U.S. PATENT DOCUMENTS

| | | | | |
|---|---|---|---|---|
| 5,708,907 | A | 1/1998 | Masuda et al. | |
| 6,038,417 | A * | 3/2000 | Nagamine et al. | 399/125 |
| 6,708,011 | B2 | 3/2004 | Nomura et al. | |
| 2005/0128282 | A1* | 6/2005 | Yamagata | 347/230 |
| 2006/0050135 | A1 | 3/2006 | Fukuda | |
| 2006/0067734 | A1 | 3/2006 | Igarashi et al. | |
| 2007/0110475 | A1* | 5/2007 | Idehara et al. | 399/118 |
| 2007/0160385 | A1 | 7/2007 | Noguchi et al. | |
| 2009/0269101 | A1* | 10/2009 | Okabe et al. | 399/114 |

FOREIGN PATENT DOCUMENTS

| | | |
|---|---|---|
| JP | 06-106814 A | 4/1994 |
| JP | 08-054817 A | 2/1996 |
| JP | 2003-043776 | 2/2003 |
| JP | 2006-098772 | 4/2006 |
| JP | 2007-069528 A | 3/2007 |

OTHER PUBLICATIONS

JP Notification of Reasons for Refusal dated Nov. 29, 2011; corresponding Application No. 2008-013715; English Translation.

* cited by examiner

*Primary Examiner* — Walter L Lindsay, Jr.
*Assistant Examiner* — Benjamin Schmitt
(74) *Attorney, Agent, or Firm* — Banner & Witcoff, Ltd.

(57) ABSTRACT

In an image forming apparatus, a support frame configured to support a plurality of cartridges each including a photoconductor is allowed to be pulled out from a casing of the apparatus. A plurality of light-emitting parts configured to expose a corresponding photoconductor to light is arranged in each exposure unit which is movable between an exposure position proximate to the corresponding photoconductor and a retreating position away from the photoconductor. A pair of side plates of the support frame, which extends in a direction perpendicular to a main direction in which the light-emitting parts are arranged, has guide slots formed therein, each of which is configured to guide movement of a corresponding exposure unit between its exposure and retreating positions. Each guide slot includes a positioning portion configured to position the exposure unit in position in a subordinate direction perpendicular to the main direction and to an exposure direction.

10 Claims, 9 Drawing Sheets

IMAGE FORMING APPARATUS

CROSS-REFERENCE TO RELATED APPLICATION(S)

This application is a continuation of prior U.S. application Ser. No. 12/358,483, filed Jan. 23, 2009, which claims the foreign priority benefit under Title 35, United States Code, §119(a)-(d), of Japanese Patent Application No. 2008-013715 filed on Jan. 24, 2008 in the Japan Patent Office, the disclosures of which are herein incorporated by reference in their entirety.

BACKGROUND OF THE INVENTION

1. Field of the Invention

The present invention relates to an image forming apparatus which includes photoconductors and exposure units, each exposure unit in use being disposed in proximity to a corresponding photoconductor.

2. Description of Related Art

Image forming apparatuses of a type are hitherto known in the art in which a plurality of photoconductors and a plurality of exposure units (e.g., LED heads) are provided such that each exposure unit is disposed in proximity to a corresponding photoconductor so as to expose the photoconductor to light. In this type of the image forming apparatuses, it is desirable to keep the associated photoconductor and exposure unit in relatively fixed positions in order that exposure of the photoconductor to light may be precisely regulated. For example, JP 2003-43776 A (the corresponding U.S. patent issued under U.S. Pat. No. 6,708,011 B2) discloses an image forming apparatus in which locating pins provided at both ends of a long-length substrate of each exposure unit are inserted into locating holes in the associated mounting struts provided on the inside surfaces of both side plates of a frame which supports the photoconductors, and fastening screws are used to fix each substrate (exposure unit) and the associated mounting strut together, so that each exposure unit is fixedly located relative to the associated photoconductor.

In such a construction for fixedly locating each of exposure units relative to the associated photoconductor as described above, each of the exposure units may be fixed precisely in an appropriate position relative to the associated photoconductor, but any photoconductor in need of replacement should be removed and replaced together with the associated exposure unit which could possibly not yet need replacing, and thus the apparatus would be disadvantaged in view of the environmental load and economic efficiency.

It would thus be desirable to provide an image forming apparatus in which each of exposure units is precisely located and fixed in position relative to an associated photoconductor while the disadvantages in view of the environmental load, economical efficiency, and the like can be overcome. The present invention has been made in an attempt to eliminate the above disadvantages. Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

SUMMARY OF THE INVENTION

In one aspect of the present invention, an image forming apparatus comprises a plurality of cartridges each of which comprises a photoconductor; a support frame configured to support the cartridges and allowed to be pulled out from a casing of the apparatus; and a plurality of exposure units each of which is movable between an exposure position proximate to a corresponding photoconductor and a retreating position away from the corresponding photoconductor, a plurality of light-emitting parts being arranged in each exposure unit and configured to expose the photoconductor to light. The support frame comprises a pair of side plates extending in a direction perpendicular to a main direction in which the light-emitting parts are arranged. Each of the side plates has guide slots formed therein, each of the guide slots being configured to guide movement of a corresponding exposure unit between the exposure and retreating positions thereof. The each of the guide slots comprises a positioning portion configured to position the corresponding exposure unit in position in a subordinate direction that is perpendicular to the main direction and to an exposure direction in which a light beam is emitted from the exposure unit to the corresponding photoconductor.

In an image forming apparatus configured as described above, each exposure unit when moving from its retreating position to its exposure position is guided to the exposure position proximate to a corresponding photoconductor, along a pair of guide slots formed in the pair of side plates of the support frame which extends in a direction perpendicular to the main direction, and is positioned at the positioning portion of each guide slot. The positioning portion of each guide slot is formed in the corresponding side plate of the support frame which supports the cartridges (photoconductors), and thus the exposure unit can be precisely positioned relative to the corresponding photoconductor at least in the subordinate direction and securely fixed in place. Moreover, with the inventive configuration implemented as described above, the operations of pulling out the support frame from the casing of the apparatus and moving any or each of the exposure units to the retreating position enable the detachment and attachment (i.e., replacement) of the corresponding cartridge(s) (photoconductor(s)) to be carried out independent of the corresponding exposure unit(s), so that when a photoconductor is to be replaced, unnecessary replacement of the corresponding exposure unit can be avoided.

According to the specific embodiments of the present invention, each of the plurality of exposure units is positioned by the positioning portion of each of the corresponding guide slots formed in the pair of side plates of the support frame, and thus the exposure units can be accurately positioned and fixed relative to the corresponding photoconductors. In addition, replacement of an exposure unit that may not necessarily be required even when a corresponding photoconductor is to be replaced can be dispensed with as the case may be; therefore, the disadvantages in view of the environmental load and economic efficiency, etc. can be overcome.

BRIEF DESCRIPTION OF THE DRAWINGS

The above aspect and advantages, other advantages and further features of the present invention will become more apparent by describing in detail illustrative, non-limiting embodiments thereof with reference to the accompanying drawings, in which.

DETAILED DESCRIPTION OF THE EXEMPLARY EMBODIMENTS

Figure 1:
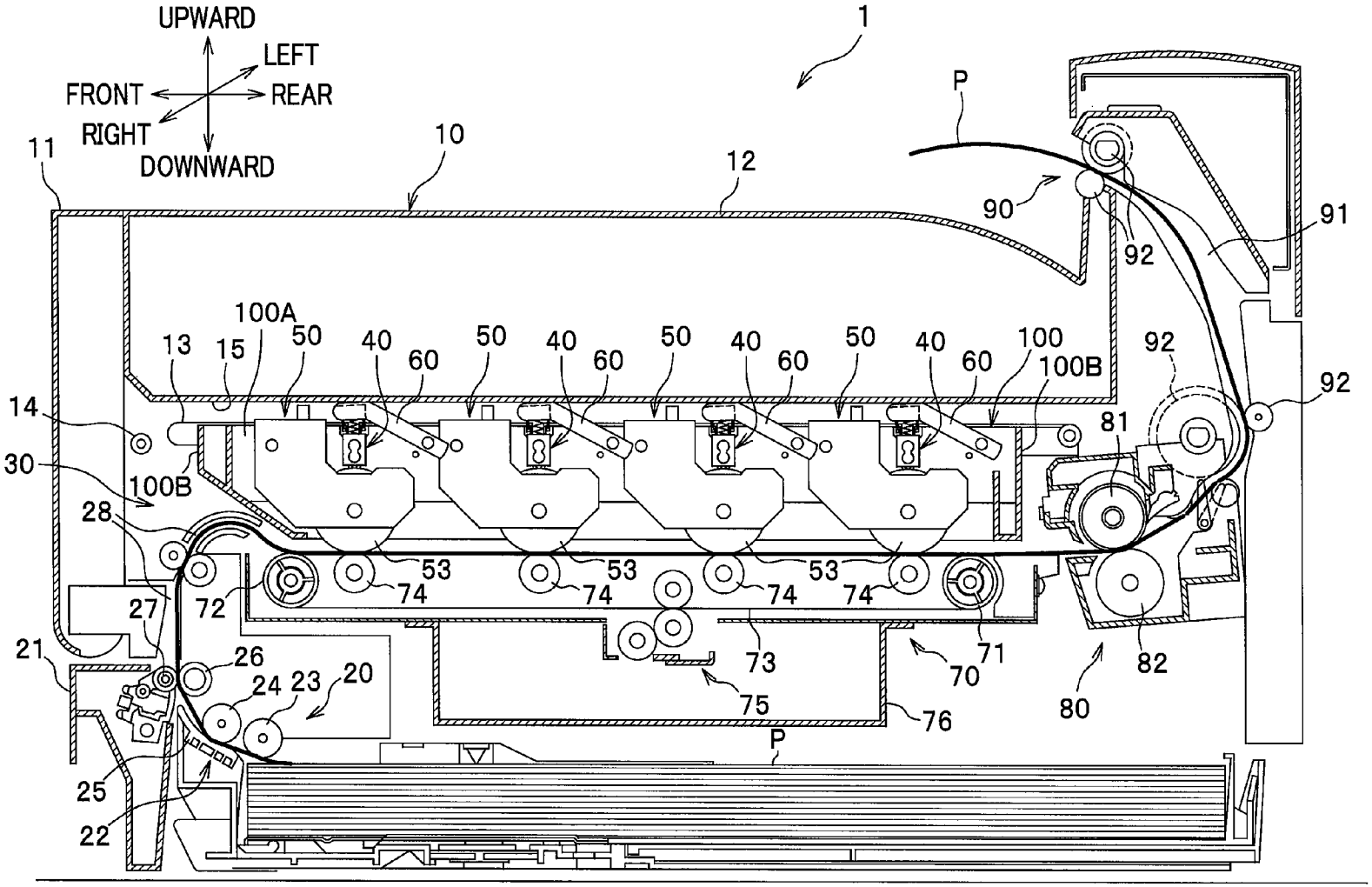
FIG. 1 is a sectional view showing a general construction of a color printer as an example of an image forming apparatus according to one exemplary embodiment of the present invention.

A detailed description will be given of exemplary embodiments of the present invention with reference to the drawings. In the following description, the direction is designated as from the viewpoint of a user who is using (operating) a color printer. To be more specific, in FIG. 1, the left side of the drawing sheet corresponds to the "front side" of the printer (image forming apparatus), and the right side of the drawing sheet corresponds to the "rear side" of the printer; the back side of the drawing sheet corresponds to the "left side" of the printer, and the front side of the drawing sheet corresponds to the "right side" of the printer. Similarly, the direction of a line extending from top to bottom of the drawing sheet corresponds to the "vertical direction" of the printer.

As shown in FIG. 1, a color printer 1 comprises a body casing 10 which makes up a housing of a main body of the printer 1. The main body housed within the body casing 10 principally includes a sheet feeder unit 20, an image forming unit 30, and a sheet output unit 90. The sheet feeder unit 20 is configured to feed a sheet P (recording sheet, e.g., of paper) to the image forming unit 30. The image forming unit 30 is configured to form an image on a sheet P fed from the sheet feeder unit 20. The sheet output unit 90 is configured to eject a sheet P on which an image has been formed in the image forming unit 30 to the outside of the body casing 10.

At the front side of the body casing 10, an openable front cover 11 is provided in such a manner as to swing open forward and shut backward about a supporting axis (pivot) located in a lower portion of the front cover 11. At the top side of the body casing 10, a sheet output tray 12 is provided which is configured to receive sheets P ejected by the sheet output unit 90 one by one through the body casing 10 so that the ejected sheets P are stacked and accumulated on the sheet output tray 12.

Also provided in the body casing 10 is a support frame 100 which is a member for supporting process cartridges 50, which will be described later. The process cartridges 50 are housed in the support frame 100 in such a manner that each process cartridge 50 can be attached to and detached from the support frame 100. The support frame 100 principally comprises a pair of metal side frames 100A (of which only one is shown) and a pair of cross members 100B. The pair of side frames 100A, as one example of a pair of side plates, extends in a direction perpendicular to a lateral direction. The pair of cross members 100B is disposed at the front and at the rear such that the front cross member 100B connects the front sides of the side frames 100A and the rear cross member 100B connects the rear sides of the side frames 100A. The support frame 100 is allowed to be pulled out to the front through an opening of the body casing 10 which opens when the front cover 11 is swung open. A specific structure of the support frame 100 will be described later in detail.

The sheet feeder unit 20 principally includes a sheet feed tray 21 provided in a lower space within the body casing 10 and detachably attached to the body casing 10, and a sheet feed mechanism 22 configured to convey a sheet P from the sheet feed tray 21 into the image forming unit 30. The sheet feed mechanism 22 is provided at a front-side portion of the sheet feed tray 21, and principally includes a sheet feed roller 23, a separation roller 24 and a separation pad 25.

In the sheet feeder unit 20 configured as described above, one sheet P at the top of the sheets P in the sheet feed tray 21 is separated from the remaining sheets P by the separation roller 24 and the separation pad 25, and is fed upward, passing across a line of contact between a paper powder remover roller 26 and a pinch roller 27 so that paper powder is removed from the sheet P while the sheet P is being fed therebetween. Thereafter, the sheet P passes along a conveyance path 28 of which a direction is turned to the rear so that the sheet P is fed into the image forming unit 30.

The image forming unit 5 principally includes four LED units 40 as one example of a plurality of exposure units, four process cartridges 50 as one example of a plurality of cartridges, a transfer unit 70 and a fixing unit 80.

Each LED unit 40 is configured to be in a position which is above and proximate to a corresponding photoconductor drum 53 as one example of a photoconductor (this position will hereinafter referred to as an exposure position), so as to expose a surface of the photoconductor drum 53 to LED light emitted from its light-emitting elements that will be described later. Each LED unit 40 is mounted to the support frame 100 via a corresponding arm part 60. A specific structure of the LED units 40 will be described later in detail.

Figure 2:
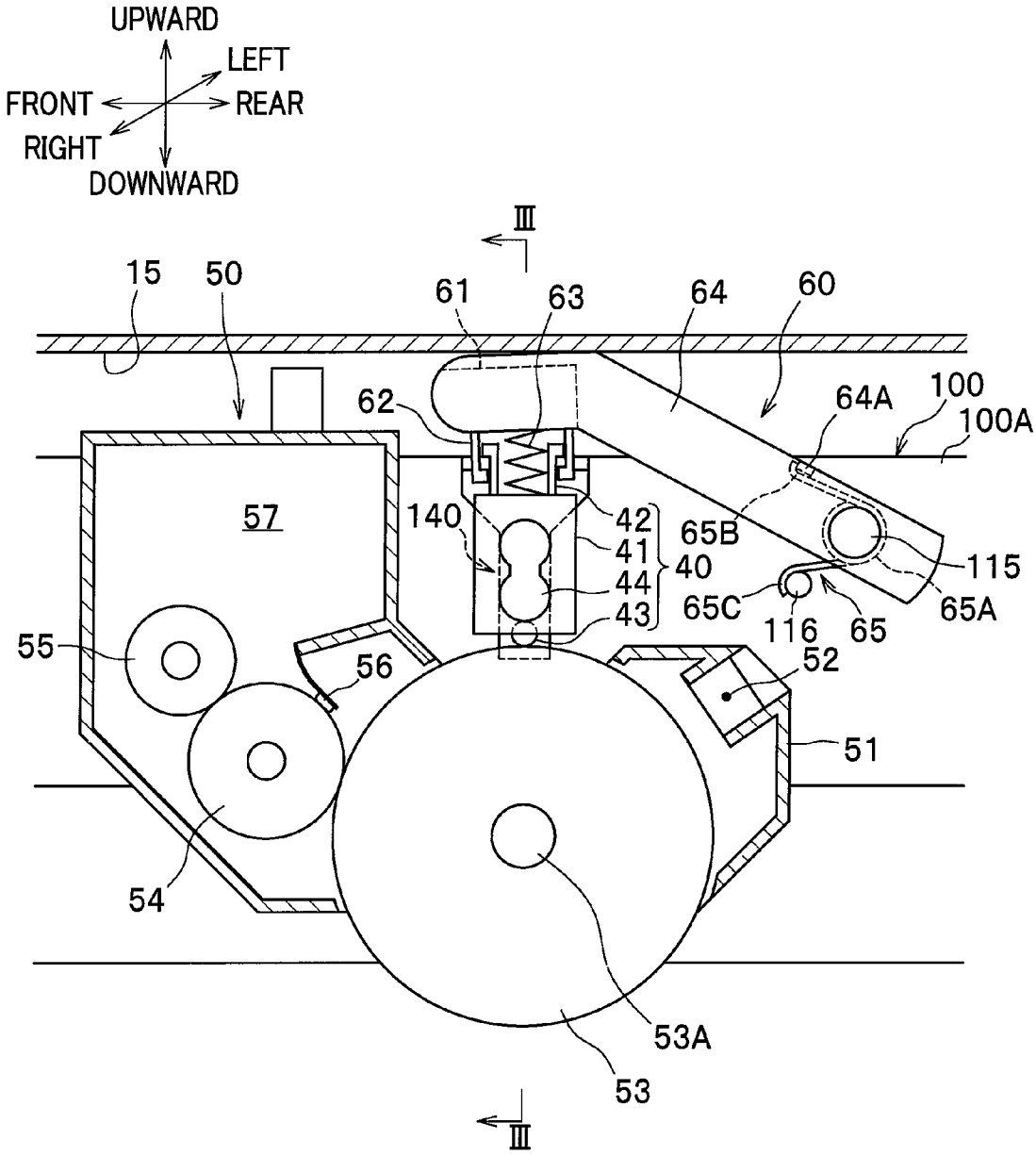
FIG. 2 is an enlarged view showing a process cartridge and an LED unit that is located in an exposure position.

The process cartridges 50 are disposed between the sheet output tray 12 and the sheet feeder unit 20 and arranged in tandem in the longitudinal (front-rear) direction of the support frame 100. Each of the process cartridges 50 comprises, as shown in FIG. 2, a cartridge frame 51 and components housed therein which principally include a charger 52, a rotatably supported photoconductor drum 53 (photoconductor), a development roller 54, a supply roller 55, and a doctor blade 56. Also provided in this embodiment is a toner container 57 in which toner (developer) is stored. These four process cartridges 50 are different from one another solely in color of toner to be stored within the respective toner containers 57, and have substantially the same construction.

The transfer unit 70 is, as shown in FIG. 1, disposed between the sheet feeder unit 20 and an array of the process cartridges 50, and principally includes a driving roller 71, a driven roller 72, a conveyor belt 73, four transfer rollers 74, and a cleaning unit 75.

The driving roller 71 and the driven roller 72, each of which is laid with its axis extending laterally, are arranged apart from and parallel to each other, and the conveyor belt 73 made up of an endless belt is looped around the driving roller 71 and the driven roller 72. The conveyor belt 73 has its outer face kept in contact with each photoconductor drum 53. The transfer rollers 74 are provided inside the conveyor belt 73 and each transfer roller 74 is disposed directly opposite to a corresponding photoconductor drum 53 so that the conveyor belt 73 is held between the transfer roller 74 and the corresponding photoconductor drum 53. A transfer bias is applied to the transfer rollers 74 by a constant current control during a transfer operation.

The cleaning unit 75 is disposed under the conveyor belt 73, and is configured such that toner remaining on and adhering to the conveyor belt 73 is removed therefrom, and let fall into a toner reservoir 76 disposed below the cleaning unit 75.

The fixing unit 80 is disposed rearward of the process cartridges 50 and the transfer unit 70, and principally includes a heating roller 81, and a pressure roller 82 which is disposed opposite to the heating roller 81 and configured to press the heating roller 81.

In the image forming unit 30 configured as described above, first, an outer cylindrical surface of each photoconductor drum 53 is uniformly charged by the corresponding scorotron charger 52, and is then exposed to LED light emitted from the light-emitting elements of the corresponding LED unit 40. As a result, a potential of an exposed portion is lowered, and an electrostatic latent image is formed on the photoconductor drum 53 in accordance with the image data.

Meanwhile, toner in each toner container 57 is supplied to the development roller 54 by the action of the rotating supply roller 55, and is then forwarded in between the development roller 54 and the doctor blade 56 by the action of the rotating development roller 54, to form a thin layer of toner having a uniform thickness retained on the development roller 54.

Toner is supplied from the development roller 54 to the photoconductor drum 53 as the development roller 54 rotates and toner retained on the development roller 54 comes in contact with the opposed surface of the photoconductor drum 53. At this time, toner is retained selectively on a part of the photoconductor drum 53 (in which an electrostatic latent image has been formed), which visualizes the electrostatic latent image to form a toner image thereon by a reversal process.

The toner images formed on the respective photoconductor drums 53 are transferred onto a sheet P one on top of another as the sheet P fed onto the conveyor belt 73 passes between the photoconductor drums 53 and the transfer rollers 74 disposed inside the conveyor belt 73.

As the sheet P passes between the heating roller 81 and the pressure roller 82, the toner images thus transferred on the sheet P are fused and fixed by heat.

The sheet output unit 90 principally includes an output-side conveyor path 91 which extends upward from an exit of the fixing unit 80 and then turns to the front, and two or more pairs of conveyor rollers 92 which are arranged to convey a sheet P ejected from the fixing unit 80 along the output-side conveyor path 91. The sheet P on which the transferred toner image has been thermally fixed is conveyed by the conveyor rollers 92 along the output-side conveyor path 91 and ejected to the outside of the body casing 10; sheets P thus ejected from the body casing 10 are stacked and accumulated on the sheet output tray 12.

The next discussion focuses on an inventive configuration for positioning each of the LED units 40 in a fixed position relative to a corresponding photoconductor drum 53.

Figure 3:
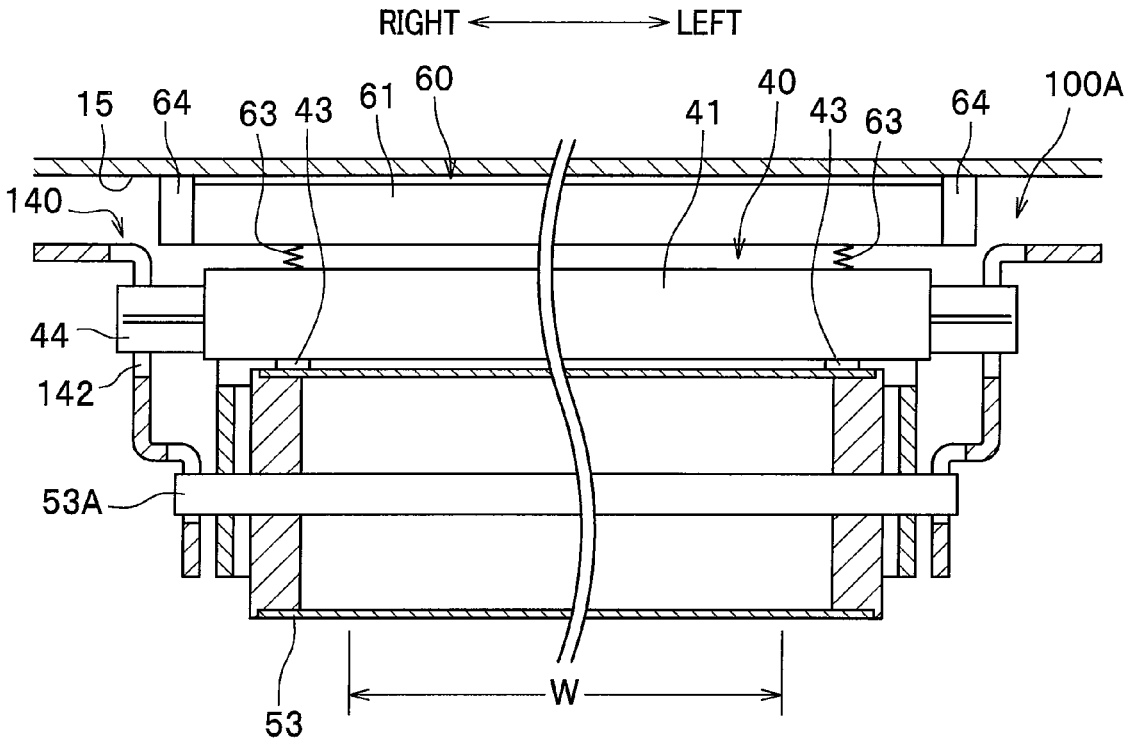
FIG. 3 is a sectional view taken along line III-III of FIG. 2.

As shown in FIGS. 2 and 3, each LED unit 40 principally includes an LED head 41, a pair of engageable claws 42, a pair of guide rollers 43, and a pair of guide ribs 44.

The LED head 41 includes a plurality of light-emitting parts or elements (not shown) composed of light-emitting diodes or LEDs, arranged laterally in a linear array at an underside of the LED head 41 in a light-emitting position. To be more specific, the LED head 41 has a head structure provided with a support member supporting a plurality of LEDs (light-emitting elements) which are arranged with a predetermined pixel pitch and configured to be driven selectively to expose the surface of the photoconductor drum 53 in a desired pattern. Each light-emitting element is configured to receive a signal from a controller (not shown) to emit light in accordance therewith, to thereby expose selected pixel areas on the surface of the photoconductor drum 53 to light.

In the following discussion, a direction (lateral direction) in which the light-emitting elements are arranged will be referred to as a main direction where appropriate. Similarly, a direction perpendicular to the main direction and to an exposure direction (vertical direction, in the present embodiment, of FIG. 2) will be referred to as a subordinate direction where appropriate. Hereupon, the exposure direction is a direction coincident with a direction of an optical axis of rays of LED light emitted from the light-emitting elements to a corresponding photoconductor drum 53 (i.e., direction of emission). Thus, more specifically, the subordinate direction is coincident with the front-rear direction or direction of arrangement of the photoconductor drums 53.

The engageable claws 42 are provided on top of an exterior (formed of resin, plastic or the like) of the LED head 41. When the engageable claws 42 are engaged loosely with an engageable receptacle 62 of an arm part 60 which will be described later, the LED head 41 (LED unit 40) is attached to the arm part 60. This configuration makes the LED unit 40 slidable with respect to the arm part 60 in the vertical direction of FIG. 2, and swingable (tiltable) in the front-rear direction of FIG. 2, in this embodiment.

The pair of guide rollers 43 is configured to roll on the surface of the photoconductor drum 53 when the LED head 41 is in the exposure position, so as to keep the corresponding LED unit 40 and photoconductor drum 53 in a relatively fixed position. To be more specific, the distance between the light-emitting elements of the LED head 41 and the surface of the photoconductor drum 53, i.e., the position of the LED unit 43 relative to the photoconductor drum 53 in the exposure direction, is determined and invariably maintained. The guide rollers 43 are, as shown in FIG. 3, configured to locate their contact surfaces in positions at both sides (on right and left sides) of the LED head 41, which are outside an image forming area W of the surface of the photoconductor drum 53 on which toner is supplied. The material of the guide rollers 43 may be selected from any materials without limitation, but may preferably be selected from those which have an adequate coefficient of friction against the photoconductor drum 53 as well as a great resistance to abrasion.

The guide ribs 44 are provided on both ends, facing to the right and to the left, of the exterior of the LED head 41 so as to project outwardly therefrom (to the right and to the left, respectively). When the guide ribs 44 are fitted into positioning portions 142 of guide slots 140 that will be described later, the position of the LED unit 40 relative to the photoconductor drum 53 in the subordinate direction (front-rear direction) is fixedly determined.

Figure 4:
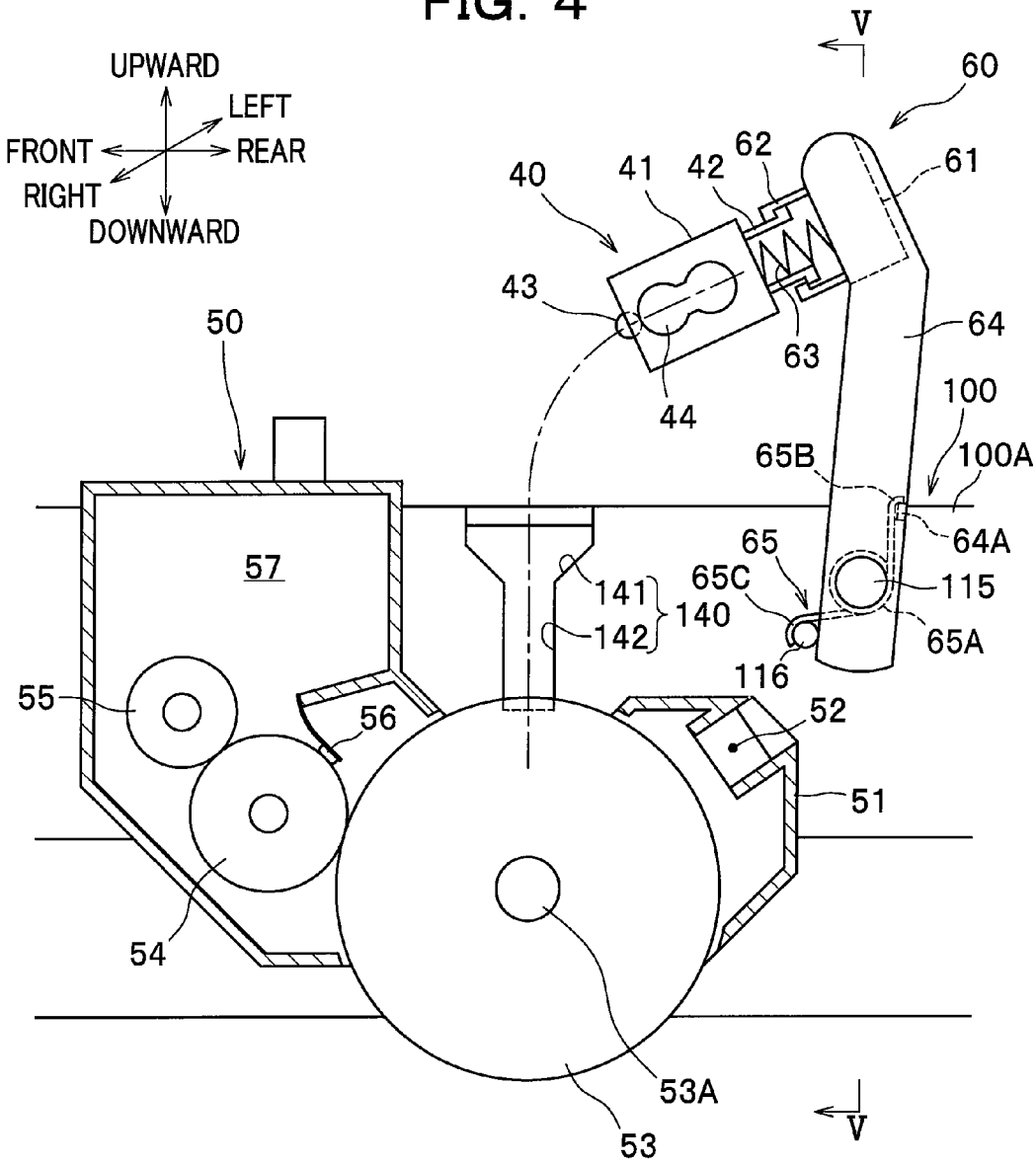
FIG. 4 is an enlarged view showing the process cartridge and the LED unit that is located in a retreating position.

As shown in FIGS. 2 and 4, the arm part 60 is used to mount the LED unit 40 to the support frame 100, and to support the LED unit 40 in such a manner that the LED unit 40 is movable between the exposure position and the retreating position. The arm part 60 includes a support portion 61, an engageable receptacle 62, a coil spring 63 as one example of a first biasing part, a pair of arms 64 and a pair of torsion springs 65 as one example of a second biasing part (see also FIG. 5).

Figure 5:
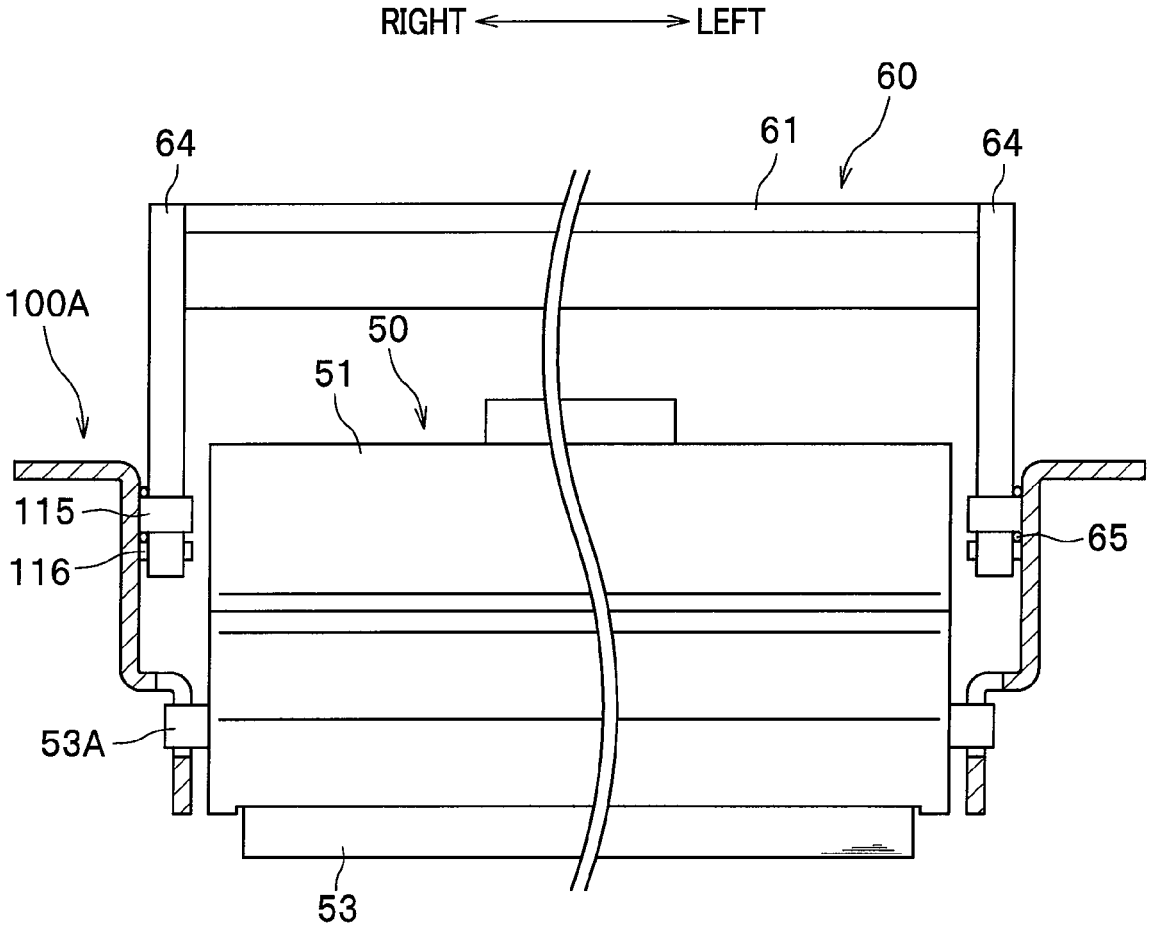
FIG. 5 is a sectional view taken along line V-V of FIG. 4.

The support portion 61 is a member made of resin, plastic or the like and shaped substantially like a quadrangular prism extending laterally (see FIG. 5).

The engageable receptacle 62 is a member which is provided on an underside of the support portion 61, and with which the engageable claws 42 of the LED unit 40 are engageable. The coil spring 63 is disposed between the LED unit 40 (LED head 41) and the arm part 60.

Each of the arms 64 is a plate-like member which extends from the right or left end of the support portion 61 rearward in FIG. 2 to a section at which the arm 64 is bent at an obtuse angle and further extends obliquely downwardly. As shown in FIG. 5, the arms 64 are combined with the support portion 61 to form a substantially U-shaped frame member. In an end portion of each of the right and left arms 64, a through hole (not denoted by reference numeral) is formed which opens to the right and left sides. When a pivot shaft 115 protruding inwardly from an inner surface of each side frame 100A is fitted in this through hole, the arm part 60 is swingably mounted to the support frame 100. The swinging motion of the arm part 60 is restricted at a position (retreating position) shown in FIGS. 4 and 5 by a pair of stoppers 116 each protruding inwardly from the inner surface of the corresponding side frame 100A.

Each of the torsion springs 65 is, as shown in FIG. 4, disposed between the corresponding arm 64 and the corresponding side frame 100A. Each torsion spring 65 has a helically coiled portion 65A wound around the corresponding pivot shaft 115, and two spring arms 65B and 65C extending from the ends of the coiled portion 65A. The spring arms 65B, 65C of each torsion spring 65 are engaged with a restrictive projection 64A projecting outwardly from the arm 64 and the stopper 116 of the side frame 100A, respectively, so that deformation of the torsion spring 65 is restricted by the range of swinging motion of the arm part 60.

The configuration as described above renders each LED unit 40 movable between the exposure position proximate to the corresponding photoconductor drum 53 as shown in FIG. 2 and the retreating position away from the corresponding photoconductor drum 53 as shown in FIG. 4. When the LED unit 40 is in the exposure position as shown in FIG. 2, a biasing (urging) force is applied to the arm part 60, which urges the LED unit 40 to swing clockwise toward the retreating position as shown in FIG. 4, by the action of the torsion spring 65. However, when the support frame 100 has been installed completely in the body casing 10, the arms 64 abut with a restricting surface 15 provided above the image forming unit 30 in the body casing 10 as shown in FIG. 2, and thus the swinging motion of the arm part 60 by the action of the torsion spring 65, i.e., the swinging motion of the LED unit 40 from the exposure position to the retreating position, is restricted by this restricting surface 15.

Figure 6:
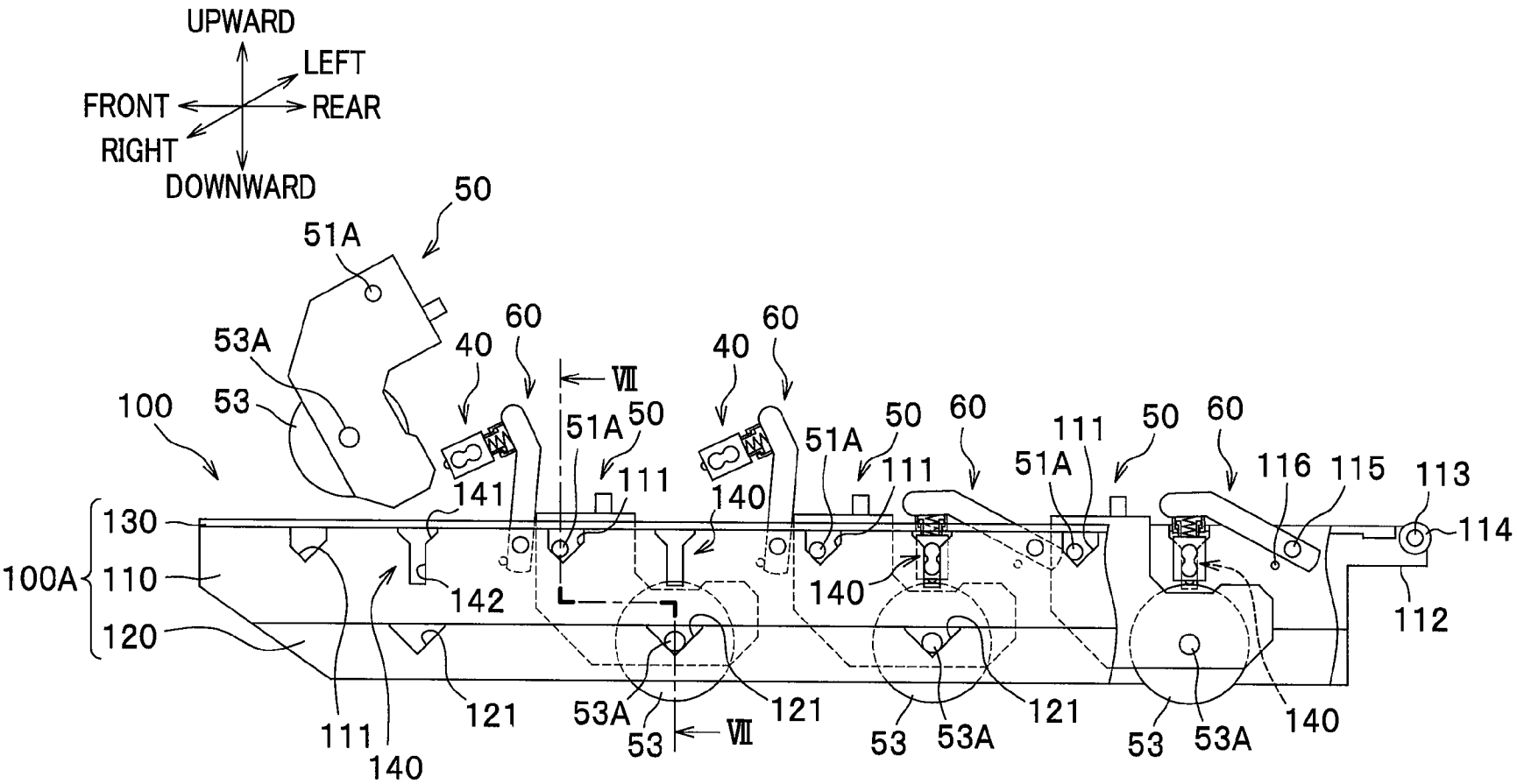
FIG. 6 is a side view showing a support frame and the process cartridges.

Referring now to FIG. 6, each of the side frames 100A provided in a pair is a metal sheet member bent at three sections (see FIGS. 7A and 7B), and principally comprises a first support portion 110, a second support portion 120, and a guide portion 130.

The first support portion 110 of each side frame 100A has four guide slots 140 and four cartridge positioning slots 111 provided therethrough. The first support portion 110 also has a roller mount portion 112 extending rearward from a rear end of the first support portion 110. At an outside of the roller mount portion 112, a guide roller 114 is rotatably provided on a shaft 113 protruding outward from the roller mount portion 112. At an inside of the first support portion 110, the four pivot shafts 115 and the four stoppers 116 are provided which protrude inwardly.

Figure 7A:
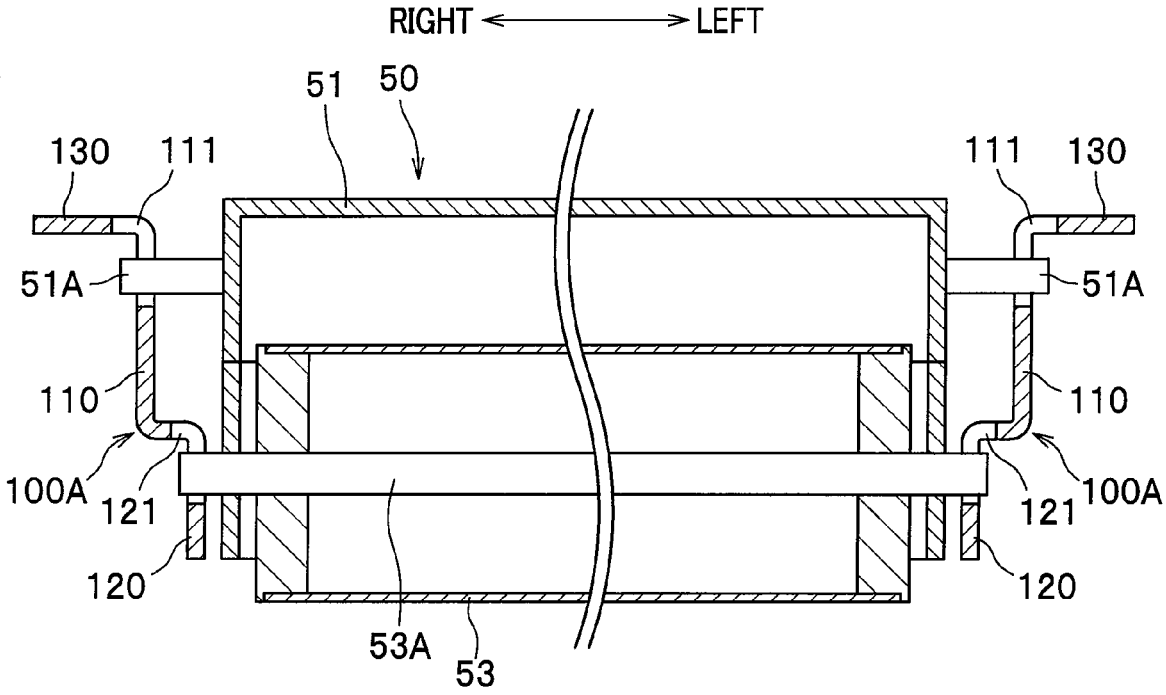
FIG. 7A is a sectional view taken along line VII-VII of FIG. 6.

Each cartridge positioning slot 111 is a recess as shown in FIG. 7A, which allows a projection 51A provided at an outer surface of the cartridge frame 51 of the process cartridge 50 to be inserted therein and withdrawn therefrom. The projection 51A is shaped substantially like a circular cylindrical column which protrudes outwardly from the outer surface of the cartridge frame 51. The cartridge positioning slot 111 serves, together with a drum positioning slot 121 that will be described later, to locate the process cartridge 50 (photoconductor drum 53) in position relative to the support frame 100.

Figure 7B:
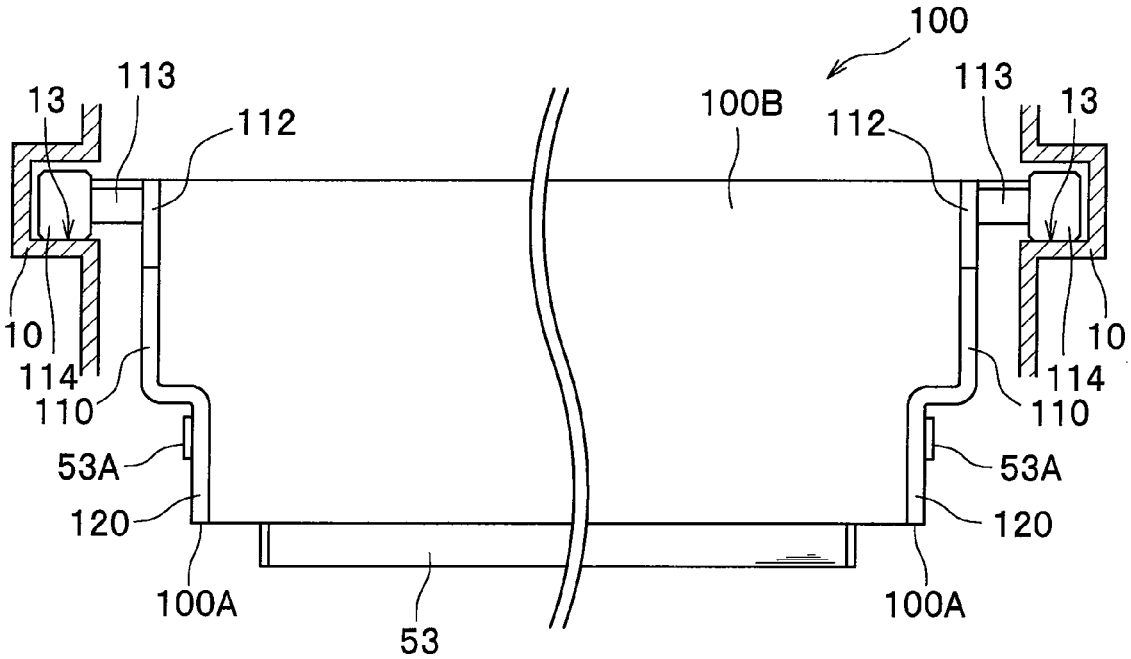
FIG. 7B is a rear view of the support frame.

The guide roller 114 is an arrangement designed to roll on within a guide rail 13 formed in the body casing 10 at each side of the support frame 100 as shown in FIG. 7B, so that the support frame 100 can be translated smoothly when the support frame 100 is pulled out from the body casing 10 or installed into the body casing 10.

The guide slot 140 is shaped like a funnel in a side view, as shown in FIG. 6, and comprises a guiding portion 141 and a positioning portion 142.

The guiding portion 141 is a portion designed to guide an LED unit 40 moving from the retreating position to the exposure position; to be more specific, the guiding portion 141 is configured to guide a guide rib 44 to the positioning portion 142 (see FIG. 4). The guiding portion 141 has an open upper end wider than the width of the positioning portion 142 in the front-rear direction, and sloped sides tapering toward an open upper end of the positioning portion 142 to which a lower end of the guiding portion 141 is connected.

The positioning portion 142 is a portion designed to receive the guide rib 44 of the LED unit 40, allowing the guide rib 44 to be fitted in the positioning portion 142, so that the LED unit 40 is positioned in position in the subordinate direction relative to the photoconductor drum 53. The positioning portion 142 is designed to have a width (in the front-rear direction) such that the guide rib 44 can be slid down along the sides of the positioning portion 142, and a lower end of the positioning portion 142 is slightly lower than the top of the photoconductor drum 53 installed in the support frame 100.

The second support portion 120 has four drum positioning slots 121 provided therethrough. Each drum positioning slot 121 is a recess as shown in FIG. 7A, which allows a shaft 53A of the photoconductor drum 53 protruding outwardly through the cartridge frame 51 to be inserted therein and withdrawn therefrom. The drum positioning slot 121 serves, together with the cartridge positioning slot 111, to locate the process cartridge 50 (photoconductor drum 53) in position relative to the support frame 100.

In the present embodiment, the cartridge positioning slots 111, the drum positioning slots 121 and the guide slots 140 of the pair of side frames 100A opposed to each other at the right side and at the left side are formed by means of one and the same die. To be more specific, for example, sheet metal for forming a pair of side frames 100A are stamped (subjected to presswork), respectively, by means of one and the same die, to thereby provide through openings which form the slots 111, 121 and 140, and then bent by means of a bending die (subjected to presswork using the bending die), so that a pair of side frames 100A in which corresponding slots are formed can be manufactured.

The guide portion 130 is a portion designed to come in contact with a guide roller 14 provided near an opening within the body casing 10 as shown in FIG. 1 (in which one of two guide rollers 14 provided at the insides of right and left sidewalls of the body casing 10 is illustrated), so that the guide rollers 14 roll on the guide portions 130 of the side frames 100A and thus the support frame 100 can be translated smoothly when the support frame 100 is pulled out from the body casing 10 or installed into the body casing 10.

A description will now be given of the operation and advantages of a color printer 1 configured as described above, with reference made chiefly to FIGS. 8 and 9.

Figure 8:
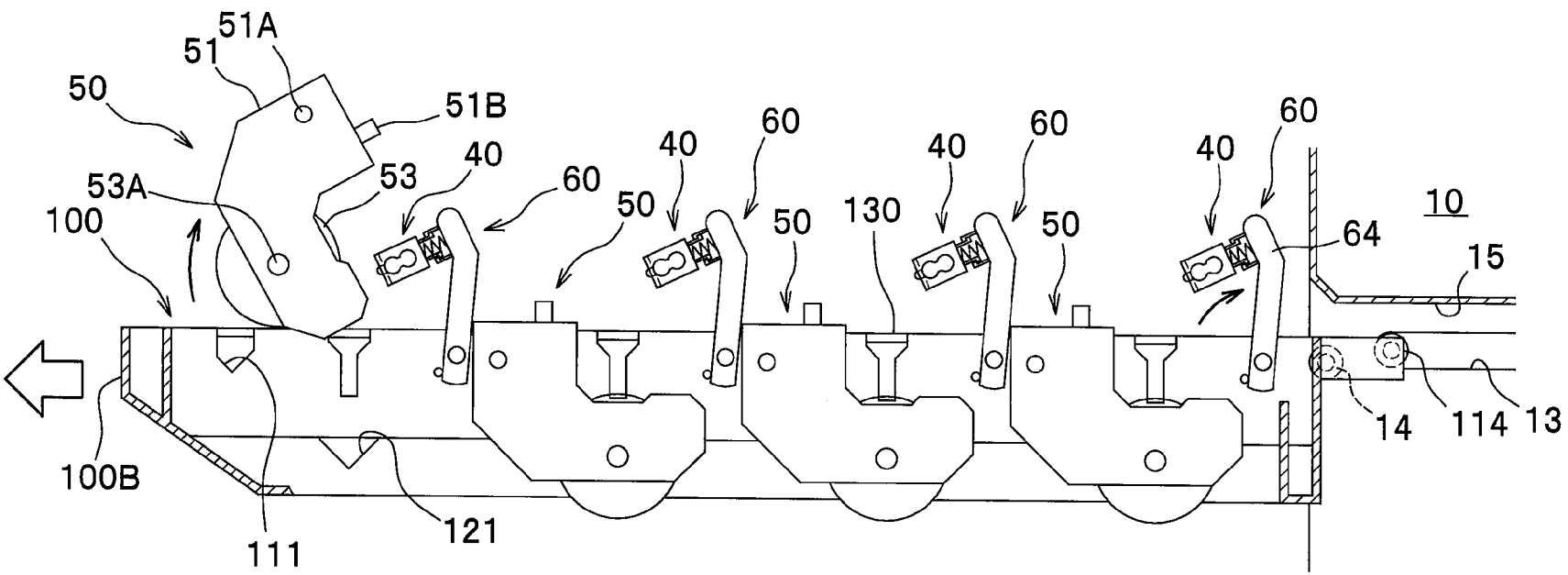
FIG. 8 is a schematic diagram for explaining the motions of the LED units caused when the support frame is pulled out.

First, when the support frame 100 is pulled out, the front cover 11 is swung open to render the support frame 100 accessible through the opening of the body casing 10, and the cross member 100B provided at the front side of the support frame 100 is grabbed and pulled frontward as shown in FIG. 8. In this operation, the guide rollers 114 roll on within the guide rails 13 and the guide portions 130 cause the guide rollers 14 to roll, so that the support frame 100 can be pulled out smoothly.

When the support frame 100 is pulled out from the body casing 10, the restricting surface 15 is moved away from above each of the arms 64, and thus the compression of the torsion spring 65 is released, with the result that each of the arm parts 60 swings clockwise. In this way, the operation of pulling out the support frame 100 automatically causes each of the LED units 40 to automatically move away from the corresponding exposure position to the corresponding retreating position. Thereafter, a grip 51B formed on a top side of each cartridge frame 51 is grabbed and the corresponding process cartridge 50 is removed and replaced with a new one.

When a process cartridge 50 is installed into the support frame 100, the shaft 53A of the photoconductor drum 53 is placed in the drum positioning slots 121, and the projections 51A provided on the cartridge frame 51 are placed in the cartridge positioning slots 111. In this way, the process cartridge 50, more specifically the photoconductor drum 53, is located in position relative to the support frame 100.

According to the present embodiment as described above, each LED unit 40 is supported by the arm part 60 which is configured to be swingable; therefore, the LED unit 40 can be moved easily from the exposure position to the retreating position. Particularly, in the present embodiment, the torsion spring 65 provided to bias the LED unit 40 toward the retreating position causes the LED unit 40 to be automatically moved to the retreating position when the support frame 100 is pulled out, and thus the color printer 1 is provided with increased operational ease.

Also, in the present embodiment, each LED unit 40 is mounted to the support frame 100 via the arm part 60, and thus the body casing 10 can be miniaturized in comparison with the case in which exposure units are mounted to an openable cover provided over the main body of the printer 1. As a result, the color printer 1 can be designed to be compact or small in size. Moreover, the present embodiment obviates the necessity for providing an openable cover over the main body of the printer 1, and thus the printer 1 may be designed without difficulty such that an image-reading (scanner) or other device is provided above the body casing 10.

Figure 9:
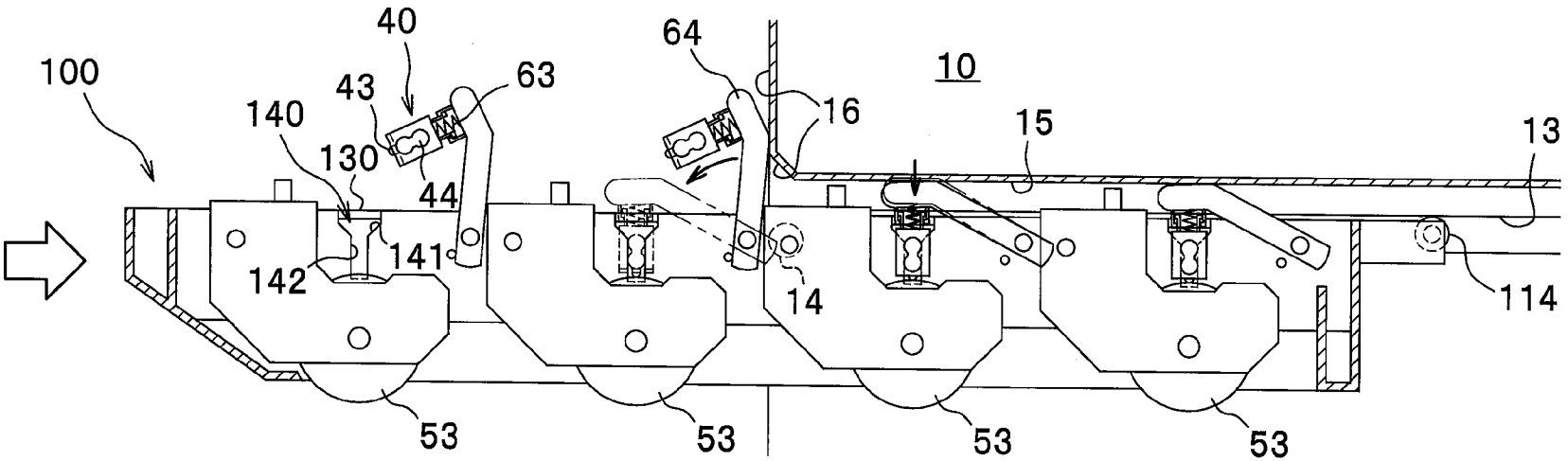
FIG. 9 is a schematic diagram for explaining the motions of the LED units caused when the support frame is being pushed into the casing of the printer.

Meanwhile, when the support frame 100 is installed, the support frame 10 is pushed in rearward as shown in FIG. 9. In this operation as well, the guide rollers 114 roll on within the guide rails 13 and the guide portions 130 cause the guide rollers 14 to roll, so that the support frame 100 can be translated smoothly.

When the support frame 100 is being pushed into the body casing 10, the arms 64 of each arm part 60 are, first, brought into contact with a guiding surface 16 provided on the body casing 10. When the support frame 100 is further pushed in, the arms 64 are pushed frontward by the guiding surface 16 and swung counterclockwise. When the arms 64 are swung to a predetermined position, the guide ribs 44 of the corresponding LED unit 40 are inserted into the guiding portions 141 of the guide slots 140. As the arms 64 swing, the guide ribs 44 are guided along the sloped sides of the guiding portions 141 to the open upper ends of the positioning portions 142, and are inserted into the positioning portions 142. When the guide ribs 44 are eventually fitted into the positioning portions 142, the guide rollers 43 come in contact with the surface of the photoconductor drum 53.

The width of each positioning portion 142 in the front-rear direction is designed narrowly such that the positioning portion 142 is barely wide enough for the guide rib, i.e., the guide rib 44 can be slid on the sides of the positioning portion 142. Therefore, once the guide ribs 44 are fitted into the positioning portions 142, the LED unit 40 can be located precisely in position in the subordinate direction (front-rear direction) relative to the photoconductor drum 53. In particular, according to the present embodiment, the guide slots 140 of the pair of side frames 100A are formed by means of one and the same die, and thus the guide slots 140 can be formed precisely in symmetry in the side frames 100A. Consequently, the position of the LED unit 40 relative to the photoconductor drum 53 in the subordinate direction can be determined precisely and retained securely.

When the support frame 100 is further pushed in and the arms 64 are brought into contact with the restricting surface 15, the arms 64 are further pushed in downward. In this operation, the coil spring 63 is compressed between the arm part 60 and the LED head 41, and thus the LED unit 40 (LED head 41) is biased toward the photoconductor drum 53. Accordingly, the position of the LED unit 40 relative to the photoconductor drum 53 in the direction of exposure (vertical direction) can be determined precisely and retained securely.

According to the present embodiment, the positioning portion 142 of each of the guide slots 140 formed in each side frame 100A is used to determine the position of the LED unit 40 in the subordinate direction relative to the photoconductor drum 53; therefore, the LED unit 40 can be appropriately positioned with a simple configuration. Also in the present embodiment, the LED unit 40 is configured to be movable between the exposure position and the retreating position, and thus replacement of the LED unit 40 which may not necessarily be required even when the corresponding process cartridge 50 (photoconductor drum 53) is to be replaced can be dispensed with as the case may be. Accordingly, the color printer 1 according to the present embodiment is excellent in view of environmental protection and economic efficiency.

Although an exemplary embodiment of the present invention has been described above, the present invention is not limited to the illustrated embodiment, and may be carried out into practice in various other ways. Thus, it is contemplated that various modifications and changes may be made to the exemplary embodiment of the invention without departing from the scope of the present invention as defined in the appended claims.

In the above-described embodiment, each LED unit 40 is attached to the support frame 100 through the arm part 60, and is configured to be moved between the exposure position and the retreating position through the swinging motion of the arm part 60, but the present invention is not limited to this specific configuration. For example, exposure units may be attached to an openable cover provided over the main body of the apparatus, so that each of the exposure units may be moved between its exposure position and its retreating position through the operation of opening and closing the cover.

Although the LED units 40 each having a plurality of light-emitting elements arranged laterally in a linear array have been described above exemplarily as one example of a plurality of exposure units, the present invention is not limited to this particular embodiment. For example, the light-emitting elements may be arranged in a front-rear direction (subordinate direction). Furthermore, the light-emitting elements (light-emitting parts) applicable as consistent with the present invention may not necessarily be LEDs, but electroluminescent (EL) devices, or other devices using luminescent material, etc. may be employed, instead.

Also, in the above-described embodiment, each exposure unit (LED unit 40) includes a plurality of LEDs (luminescent elements) by way of example; however, the present invention is not limited to this particular embodiment, and a single luminescent or light-emitting element (i.e., light source) may suffice for forming a plurality of light-emitting parts. For example, a backlight such as a fluorescent lamp or LED may be provided at the back of optical shutters made of a liquid crystal or PLZT material and arranged in an array. That is, the use of one luminescent element (light source) and an array of optical shutters in combination can form a plurality of light-emitting parts arranged in an array. In this alternative configuration, the light source (luminescent element) may be composed of a plurality of light-emitting elements.

In the above-described embodiment, a cartridge is designed as a process cartridge 50 which is a single cartridge containing a photoconductor drum 53, a development roller 54 and a toner container 57, but the present invention is not limited to this particular configuration. For example, a cartridge consistent with the present invention comprises a photoconductor drum (photoconductor) but the development roller and the toner container may be contained in another cartridge which is configured to be separable from the cartridge containing the photoconductor drum (photoconductor). Alternatively, a cartridge containing the photoconductor drum (photoconductor), a cartridge containing the development roller and a cartridge containing the toner container (i.e., toner cartridge) may be provided individually and separable from one another.

Furthermore, in the above-described embodiment, a specific configuration has been illustrated such that each LED unit 40 is moved independently to its retreating position by the action of the torsion spring 65 as the support frame 100 is pulled out from the body casing 10, but the present invention is not limited to this specific configuration. For example, an alternative configuration may be adopted such that all exposure units are moved to the retreating positions after the support frame has been pulled out from the body casing to the extremity. The illustrated configuration in the above-described embodiment, however, may be preferable in that, for example, each LED unit 40 can be moved independently to its retreating position and thus only one or a few of the process cartridges 50 disposed outside the body casing when the support frame 100 has been pulled out halfway can be rendered replaceable, that is, the convenience of operation is improved.

Furthermore, in the above-described embodiment, the arm part 60 is swung by the action of the torsion springs 65 when the support frame 100 is pulled out so that the LED unit 40 is automatically moved to the retreating position, but the present invention is not limited to this particular configuration. For example, the swinging motion of an arm part to move an exposure unit to its retreating position may be imparted manually.

Furthermore, in the above-described embodiment, the guide rollers 43 are provided to locate the LED unit 40 in position relative to the photoconductor drum 53 in the direction of exposure (vertical direction), but the present invention is not limited to this particular configuration. For example, an alternative configuration may be adopted such that the lower ends of the guide ribs 44 are brought into contact with the lower ends of the positioning portions 142 so that the position of the LED unit 40 relative to the photoconductor drum 53 in the direction of exposure may be determined appropriately. Alternatively, a sliding contact member made of a material having a low coefficient of friction and a high resistance to abrasion may be provided, instead of the guide rollers 43 (roller-like member). The illustrated configuration in the above-described embodiment, however, may be preferable in that the use of such a roller serves to prevent abrasion caused by sliding contact with the photoconductor and to keep the photoconductor at a certain distance from the corresponding exposure unit.

Furthermore, in the above-described embodiment, the photoconductor drum 53, coil spring 63 and torsion spring 65 are adopted as examples of a photoconductor, a first biasing part and a second biasing part, respectively, which are consistent with the present invention. However, the present invention is not limited thereto. That is, the material and/or structure of these elements may be changed or modified where appropriate without departing from the scope of the present invention. For example, the first biasing part and/or the second biasing part may be composed of a leaf spring or others.

The invention claimed is:

1. An image forming apparatus comprising:

a plurality of cartridges each of which comprises a photoconductor;

a plurality of exposure units each of which is movable between an exposure position proximate to a corresponding photoconductor and a retreating position away from the corresponding photoconductor, a plurality of light-emitting parts being arranged in each exposure unit and configured to expose the corresponding photoconductor to light, each exposure unit having a guide rib;

a support frame configured to support the cartridges and allowed to be pulled out from a casing of the apparatus, the support frame comprising a pair of side plates extending in a direction perpendicular to a main direction in which the light-emitting parts are arranged, each of the side plates having guide slots each configured to allow the guide rib of a corresponding exposure unit to be slid inside the guide slot to guide movement of the corresponding exposure unit between the exposure position and the retreating position; and a plurality of arm parts, which are respectively swingably mounted to the support frame and by which the plurality of exposure units are supported in such a manner that each exposure unit is independently movable between the exposure position and the retreating position, wherein the guide rib of each exposure unit is configured to protrude outward in the main direction, each of the guide slots extends in an exposure direction in which a light beam is emitted from the exposure unit to the corresponding photoconductor, and comprises a positioning portion configured to position the corresponding exposure unit in a position in a subordinate direction that is perpendicular to the main direction and to the exposure direction, and a guide portion configured to guide the guide rib moving to the positioning portion.

2. The image forming apparatus according to claim 1, wherein at least portions including the guide slots of the pair of side plates are formed by the same die.

3. The image forming apparatus according to claim 1, further comprising a plurality of first biasing parts each of which is configured to bias a corresponding one of the exposure units toward the corresponding photoconductor.

4. The image forming apparatus according to claim 1, wherein the plurality of exposure units are mounted to the support frame.

5. The image forming apparatus according to claim 1, wherein a distance from each exposure unit in the retreating position to a surface of the corresponding photoconductor in the exposure direction is greater than a distance from the exposure unit in the exposure position to the surface of the corresponding photoconductor in the exposure direction.

6. An image forming apparatus comprising:

a plurality of cartridges each of which comprises a photoconductor;

a plurality of exposure units each of which is movable between an exposure position proximate to a corresponding photoconductor and a retreating position away from the corresponding photoconductor, a plurality of light-emitting parts being arranged in each exposure unit and configured to expose the corresponding photoconductor to light;

a support frame configured to support the cartridges and allowed to be pulled out from a casing of the apparatus, the support frame comprising a pair of side plates extending in a direction perpendicular to a main direction in which the light-emitting parts are arranged, each of the side plates having guide slots each configured to guide movement of a corresponding exposure unit between the exposure position and the retreating position; and a plurality of arm parts which are respectively swingably mounted to the support frame and by which the plurality of exposure units are supported in such a manner that each exposure unit is independently movable between the exposure position and the retreating position, wherein each of the guide slots extends in an exposure direction in which a light beam is emitted from the exposure unit to the corresponding photoconductor, and comprises a positioning portion configured to position the corresponding exposure unit in a position in a subordinate direction that is perpendicular to the main direction and to the exposure direction.

7. The image forming apparatus according to claim 6, wherein at least portions including the guide slots of the pair of side plates are formed by the same die.

8. The image forming apparatus according to claim 6, further comprising a plurality of first biasing parts each of which is configured to bias a corresponding one of the exposure units toward the corresponding photoconductor.

9. The image forming apparatus according to claim 6, wherein the plurality of exposure units are mounted to the support frame.

10. The image forming apparatus according to claim 6, wherein a distance from each exposure unit in the retreating position to a surface of the corresponding photoconductor in the exposure direction is greater than a distance from the exposure unit in the exposure position to the surface of the corresponding photoconductor in the exposure direction.

* * * * *